US009053691B2

(12) United States Patent
Sasaki et al.

(10) Patent No.: US 9,053,691 B2
(45) Date of Patent: Jun. 9, 2015

(54) MUSICAL PERFORMANCE EVALUATION DEVICE, MUSICAL PERFORMANCE EVALUATION METHOD AND STORAGE MEDIUM

(71) Applicants: Hiroyuki Sasaki, Ome (JP); Junichi Minamitaka, Kokubunji (JP)

(72) Inventors: Hiroyuki Sasaki, Ome (JP); Junichi Minamitaka, Kokubunji (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/253,549

(22) Filed: Apr. 15, 2014

(65) Prior Publication Data

US 2014/0305287 A1 Oct. 16, 2014

(30) Foreign Application Priority Data

Apr. 16, 2013 (JP) ..... 2013-085341

(51) Int. Cl.

| | |
|---|---|
| ***A63H 5/00*** | (2006.01) |
| ***G04B 13/00*** | (2006.01) |
| ***G10H 7/00*** | (2006.01) |
| ***G10H 1/00*** | (2006.01) |

(52) U.S. Cl.

CPC ..... *G10H 1/0066* (2013.01); *G10H 2210/091* (2013.01)

(58) Field of Classification Search

CPC ..... G10H 2210/091

USPC ..... 84/609

See application file for complete search history.

(56) References Cited

U.S. PATENT DOCUMENTS

| | | | | |
|---|---|---|---|---|
| 6,751,439 | B2 * | 6/2004 | Tice et al. | 434/350 |
| 7,199,298 | B2 * | 4/2007 | Funaki | 84/477 R |
| 7,538,266 | B2 * | 5/2009 | Takehisa | 84/609 |
| 2001/0004861 | A1 * | 6/2001 | Suzuki et al. | 84/609 |
| 2001/0039870 | A1 * | 11/2001 | Shimaya et al. | 84/478 |
| 2003/0167903 | A1 * | 9/2003 | Funaki | 84/477 R |
| 2004/0055441 | A1 * | 3/2004 | Katsuta | 84/470 R |
| 2004/0123726 | A1 * | 7/2004 | Kato et al. | 84/609 |
| 2008/0078281 | A1 * | 4/2008 | Katsuta | 84/609 |
| 2013/0074679 | A1 * | 3/2013 | Minamitaka | 84/609 |

FOREIGN PATENT DOCUMENTS

| | | |
|---|---|---|
| JP | 2008-242131 | 10/2008 |
| JP | 5050606 | 8/2012 |

* cited by examiner

*Primary Examiner* — Jeffrey Donels
(74) *Attorney, Agent, or Firm* — Cozen O'Connor

(57) ABSTRACT

In the present invention, a CPU obtains the number of notes for each skill type from note data included in a phrase segment for which musical performance input has been performed, compares the note data included in the phase segment for which the musical performance input has been performed and musical performance data inputted by the musical performance so as to obtain the number of correctly played notes for each skill type, and accumulates evaluation values for the respective skill types each found by multiplying an accuracy rate for each skill type obtained from the obtained number of notes and the obtained number correctly played notes for each skill type by a skill value of each type so as to obtain an overall musical performance evaluation value.

6 Claims, 9 Drawing Sheets

FIG. 3A

| CORRECT/ERROR TABLE FOR RIGHT HAND RT | | MUSICAL PIECE DATA (RIGHT-HAND PART) | | | | | |
|---|---|---|---|---|---|---|---|
| | | NOTE DATA 1 | NOTE DATA 2 | NOTE DATA 3 | NOTE DATA 4 | ... | NOTE DATA n |
| MUSICAL PERFORMANCE INPUT DATA (RIGHT-HAND PART) | MUSICAL PERFORMANCE DATA 1 | 1 | | | | | |
| | MUSICAL PERFORMANCE DATA 2 | | 1 | | | | |
| | MUSICAL PERFORMANCE DATA 3 | | | 0 | | | |
| | MUSICAL PERFORMANCE DATA 4 | | | | 1 | | |
| | ⋮ | | | | | | |
| | MUSICAL PERFORMANCE DATA n | | | | | | 0 |

1:CORRECT
0:ERROR

FIG. 3B

| CORRECT/ERROR TABLE FOR LEFT HAND LT | | MUSICAL PIECE DATA (LEFT-HAND PART) | | | | | |
|---|---|---|---|---|---|---|---|
| | | NOTE DATA 1 | NOTE DATA 2 | NOTE DATA 3 | NOTE DATA 4 | ... | NOTE DATA n |
| MUSICAL PERFORMANCE INPUT DATA (LEFT-HAND PART) | MUSICAL PERFORMANCE DATA 1 | 0 | | | | | |
| | MUSICAL PERFORMANCE DATA 2 | | 1 | | | | |
| | MUSICAL PERFORMANCE DATA 3 | | | 1 | | | |
| | MUSICAL PERFORMANCE DATA 4 | | | | 0 | | |
| | ⋮ | | | | | | |
| | MUSICAL PERFORMANCE DATA n | | | | | | 1 |

1:CORRECT
0:ERROR

FIG. 3C

| CORRECT/ERROR TABLE FOR BOTH HANDS RLT | | MUSICAL PIECE DATA (BOTH-HAND PART) | | | | | |
|---|---|---|---|---|---|---|---|
| | | NOTE DATA 1 | NOTE DATA 2 | NOTE DATA 3 | NOTE DATA 4 | ... | NOTE DATA n |
| MUSICAL PERFORMANCE INPUT DATA (BOTH-HAND PART) | MUSICAL PERFORMANCE DATA 1 | 1 | | | | | |
| | MUSICAL PERFORMANCE DATA 2 | | 0 | | | | |
| | MUSICAL PERFORMANCE DATA 3 | | | 1 | | | |
| | MUSICAL PERFORMANCE DATA 4 | | | | 0 | | |
| | ⋮ | | | | | | |
| | MUSICAL PERFORMANCE DATA n | | | | | | 0 |

1:CORRECT
0:ERROR

MUSICAL PERFORMANCE EVALUATION DEVICE, MUSICAL PERFORMANCE EVALUATION METHOD AND STORAGE MEDIUM

CROSS-REFERENCE TO RELATED APPLICATION

This application is based upon and claims the benefit of priority from the prior Japanese Patent Application No. 2013-085341, filed Apr. 16, 2013, the entire contents of which are incorporated herein by reference.

BACKGROUND OF THE INVENTION

1. Field of the Invention

The present invention relates to a musical performance evaluation device, as musical performance evaluation method, and a storage medium suitable for use in an electronic musical instrument.

2. Description of the Related Art

A device is known which compares note data of an etude serving as a model and musical performance data generated in response to a musical performance operation on that etude, and evaluates the musical performance ability of a user (instrument player). As this type of technology, Japanese Patent Application Laid Open (Kokai) Publication No. 2008-242131 discloses a technology of calculating an accuracy rate according to the number of notes correctly played based on a comparison between musical performance data inputted by a musical performance and prepared data corresponding to a musical performance model, and evaluating the musical performance ability of the user based on calculated accuracy rate.

However, all that is performed in the technology disclosed in Japanese Patent Application Laid-Open (Kokai) Publication No. 2008-242131 is the calculation of an accuracy rate according to the number of notes correctly played and the evaluation of the musical performance ability of the user based on the calculation accuracy rate. Therefore, there is a problem in that the degree of improvement in the musical performance ability of a user cannot be evaluated when the user performs a musical performance practice on a part of a musical place such as a phrase.

SUMMARY OP THE INVENTION

The present invention has been conceived in light of the above described problem. An object of the present invention is to provide a musical performance evaluation device, a musical performance evaluation method, and a storage medium by which the degree of improvement in a user's musical performance ability can be evaluated even when a musical performance practice on a part of a musical piece is performed.

In order to achieve the above-described object, in accordance with one aspect of the present invention, there is provided a musical performance evaluation device comprising: a first obtaining section which obtains number of notes for each skill type from note data included in a segment of an inputted musical piece, among pieces of note data including at least a skill value and a skill type for each sound constituting the musical piece; a second obtaining section which obtains number of correctly played notes for each skill type by comparing the note data included in the predetermined segment of the inputted musical piece among the pieces of note data and inputted musical performance data; and an evaluating section which accumulates evaluation values of respective skill types each obtained based on an accuracy rate for each skill type defined by the number of notes and the number of correctly played notes for each type obtained by the first obtaining section and the second obtaining section an a skill value of each skill type, and generates a musical performance evaluation value.

In accordance with another aspect of the present invention, there is provided a musical performance evaluation method comprising: a step of obtaining number of notes for each skill type from note data included in a segment of an inputted musical piece, among pieces of note data including at least a skill value and a skill type for each sound constituting the musical piece; a step of obtaining number of correctly played notes for each skill type by comparing the note data included in the predetermined segment of the inputted musical piece among the pieces of note data and inputted musical performance data; and a step of accumulating evaluation values for respective skill types each obtained based on accuracy rate for each skill type defined by the obtained number of notes and the obtained number of correctly played notes for each skill type and a skill value of each skill type, and generating a musical performance evaluation value.

In accordance with another aspect of the present invention, there is provided a non-transitory computer-readable storage medium having stored thereon a program that is executable by a computer, the program being executable by the computer to perform functions comprising: processing for obtaining number of notes for each skill type from note data included in a segment of a musical piece inputted by musical performance, among pieces of note data including at least a skill value and a skill type for each sound constituting the musical piece; processing for obtaining number of correctly played notes for each skill type by comparing the note data included in the predetermined segment of the musical piece inputted by the musical performance among the pieces of note data and musical performance data generated by musical performance input for the predetermined segment of the musical piece; and processing for accumulating evaluation values for respective skill types each obtained based on an accuracy rate for each skill type defined by the obtained number of notes and the obtained number of correctly played notes for each skill type and a skill value of each skill type, and generating a musical performance evaluation value.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 3A is a diagram showing the structure of a correct/error table for the right hand RT;

FIG. 3B is a diagram showing the structure of a correct/error table for the left hand LT;

FIG. 3C is a diagram showing the structure of a correct/error table for both hands RLT;

DETAILED DESCRIPTION OF THE PREFERRED EMBODIMENT

An embodiment of the present invention is described below with reference to the drawings.

A. Structure

Figure 1:
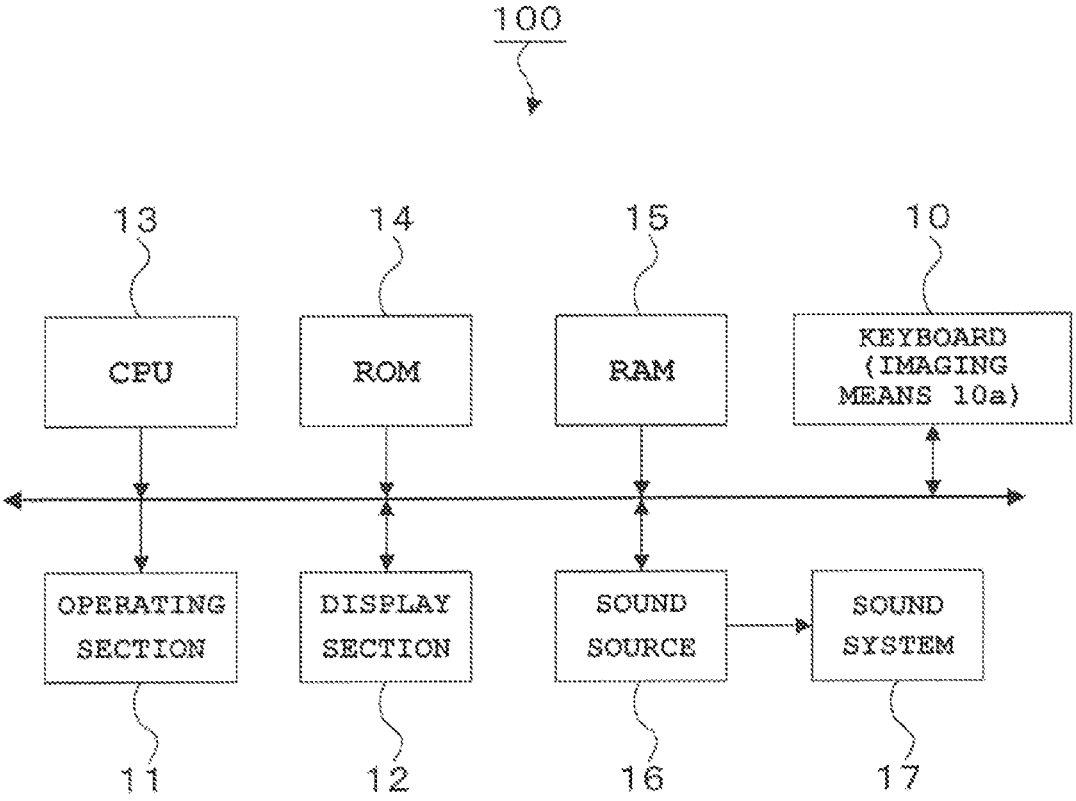
FIG. 1 is a block diagram showing the entire structure of a musical performance evaluation device 100 according to an embodiment.

FIG. 1 is a block diagram showing the entire structure of a musical performance evaluation device 100 according to an embodiment. A keyboard 10 in FIG. 1 generates musical performance information including a key-on/key-off event, a key number, and velocity in response to press/release key operation. This keyboard 10 includes imaging means 10*a* that images both right and left hands of a user put on the keyboard. Based on a musical performance input image taken by this imaging means 10*a*, a CPU 13 generates a finger number representing a finger pressing a key, and a musical performance part. The musical performance part represents data for identifying the hand of a finger pressing a key, such as the right hand, the left hand, or both hands.

An operating section 11 in FIG. 1 has various operation switches arranged on a device panel, and generates a switch event corresponding to a switch type operated by a user. Examples of a main switch arranged on the operating section 11 include a power supply switch for power ON/OFF and a practice switch for instructing to start or end musical performance input (musical performance practice). When an instruction to start musical performance input (musical performance practice) is given by an ON operation of the practice switch, the CPU 13 described below starts keeping elapsed time from the start of the musical performance input, and obtains a time of a key operation.

A display section 12 in FIG. 1 is constituted by an LCD panel or the like, and displays a musical score of musical piece data serving as a model, a musical performance evaluation result after the end of musical performance input, and the operation status and the setting status of the device, in response to a display control signal supplied from the CPU 13. The CPU 13 converts musical performance information generated in response to musical performance input by the keyboard 10 to musical performance data in a MIDI (Musical Instrument Digital Interface) format (such as note-ON/note-OFF), supplies the converted musical performance data to a sound source 16, and instructs the sound source 16 to emit musical sound.

Figure 2:
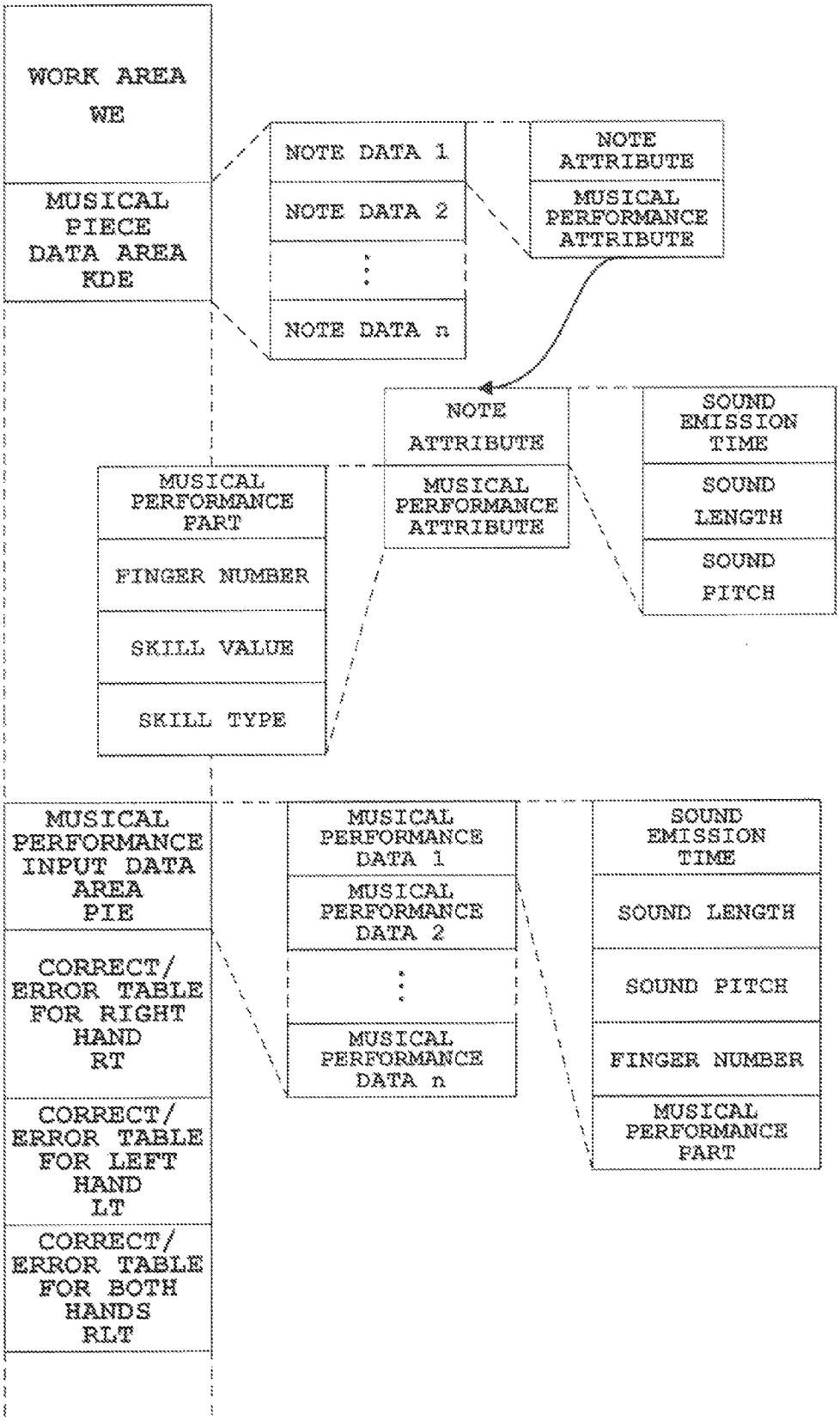
FIG. 2 is a memory map for describing main data that is stored in a RAM 12.

Also, the CPU 13 generates musical performance data constituted by "sound emission time", "sound length", "sound pitch", "finger number", and "musical performance part" based on musical performance data in the MIDI format generated when musical performance input is performed, the finger number, the musical performance part, and the time of the press/release key operation, and stores the generated musical performance data in a musical performance data input area PIE of a RAM 15 (refer to FIG. 2). In this musical performance data input area PIE, musical performance data 1 to musical performance data n generated by musical performance input for an arbitrary phrase segment (for example, four bars) of an etude serving as a model are stored. As will be described further below, the CPU 13 evaluates the degree of improvement in the user's musical performance ability based on a comparison between the musical performance data 1 to n of the phrase segment stored in the musical performance data input area PIE and the note data of the phrase segment for which the musical performance input has been performed, among the musical piece data of the etude serving as a model. The characteristic processing operation of the CPU 13 according to the present invention will be described in detail further below.

In a ROM 14 in FIG. 1, various control programs that are loaded to the CPU 13 are stored. These control programs include those for the main routine described below and musical piece data read processing, musical performance input data read processing, musical performance judgment processing, and musical performance evaluation processing that are called from the main routine.

A RAM 15 in FIG. 1 includes a work area WE, a musical piece data area KDE, the musical performance data input area PIE, a correct/error table for the right hand RT, a correct/error table for the left hand LT, and a correct/error table for both hands RLT, as depicted in FIG. 2. In the work area WE of the RAM 15, various registers and flag data for use in processing by the CPU 13 are temporarily stored. In the musical piece data area KDE of the RAM 15, musical piece data that serves as a model (musical performance model) is stored. This musical piece data is constituted by note data 1 to n representing the respective notes of a musical piece.

The note data includes a note attribute and a musical performance attribute. The note attribute is constituted by "sound emission times", "sound length", and "sound pitch". The musical performance attribute is constituted by "musical performance part", "finger number", "skill value", and "skill type". "Musical performance part" represents a right-hand part, a left-hand part, or a both-hand part. The both-hand part indicates chord musical performance in which a plurality of sounds are simultaneously emitted. "Finger number" represents a finger pressing a key, and the thumb to the little finger are represented by "1" to "5", respectively. "Skill value" represents the degree of difficulty in musical performance technique represented by "skill type" (the type of musical performance technique) such as finger underpassing or finger overpassing.

The correct/error table for the right hand RT is a table in which musical performance data and note data are arranged in a matrix, as depicted in FIG. 3A. The musical performance data 1 to n serving as row elements are obtained by extracting pieces of musical performance data of a right-hand part from musical performance data of one phrase inputted by musical performance (press/release key operation) for a predetermined phrase segment in an etude and stored in the musical performance data input area PIE, and arranging these pieces of musical performance data in the order in which the musical piece proceeds. On the other hand, note data 1 to n serving as column elements are obtained by extracting pieces of note data of the right-hand part in the phrase segment for which the musical performance input has been performed by the user from the musical piece data serving as a model, and arranging these pieces of note data in the order in which the musical piece proceeds.

Diagonal elements between the musical performance data 1 to n serving as row elements and the note data 1 to n serving as column elements are each provided with a correct/error flag indicating whether a note has been played in the same manner as that of a model, or in other words, a sound matching with the note attribute of note data has been emitted by musical performance with a specified musical performance part and a specified finger number. If the note has been played in the same manner as that of the model, the correct/error flag is set at "1". If the note has not been played in the same manner as that of the model, the correct/error flag is set at "0".

The correct/error table for the left hand LT and the correct/error table for both hands RLT depicted in FIG. 3B and FIG. 3C each have a similar structure as that of the correct/error table for the right hand RT described above. However, in the correct/error table for the left hand LT, the musical performance data 1 to n serving as row elements are obtained by extracting pieces of musical performance data of a left-hand part from the musical performance data of one phrase stored in the musical performance data input area PIE, and arranging these pieces of musical performance data in the order in which the musical piece proceeds. In addition, the note data 1 to n serving as column elements are obtained by extracting pieces of note data of the left-hand part in the phrase segment for which the musical performance input has been performed by the user from the musical piece data serving as a model, and arranging these pieces of note data in the order in which the musical piece proceeds.

In the correct/error table for both hands RLT, the musical performance data 1 to n serving as row elements are obtained by extracting pieces of musical performance data of a both-hand part from the musical performance data of one phrase stored in the musical performance data input area PIE, and arranging these pieces of musical performance data in the order in which the musical piece proceeds. In addition, the note data 1 to n serving as column elements are obtained by extracting pieces of note data of the both-hand part in the phrase segment for which the musical performance input has been performed by the user from the musical piece data serving as a model, and arranging these piece of note data in the order in which the musical piece proceeds.

Next, the configuration of the present embodiment is described with reference to FIG. 1 again. The sound source 16 in FIG. 1 is constituted by a known waveform memory read method, and generates and emits musical sound based on musical performance data in the MIDI format supplied from the CPU 13. A sound system 17 in FIG. 1 converts musical sound data outputted from the sound source 16 to an analog musical sound signal, performs filtering of the analog musical sound signal such as removing unwanted noise from the musical sound signal, amplifies the level of the musical sound signal, and causes the sound to be emitted from a loudspeaker.

B. Operation

Next, the operation of the above-structured musical performance evaluation device 100 is described with reference to FIG. 4 to FIG. 8. In the following descriptions, the main routine, the musical piece data read process, the musical performance input data read processing, the musical performance judgment processing, and the musical performance evaluation processing constituting the main routine, which are performed by the CPU 13, are respectively explained.

(1) Operation of Main Routine

Figure 4:
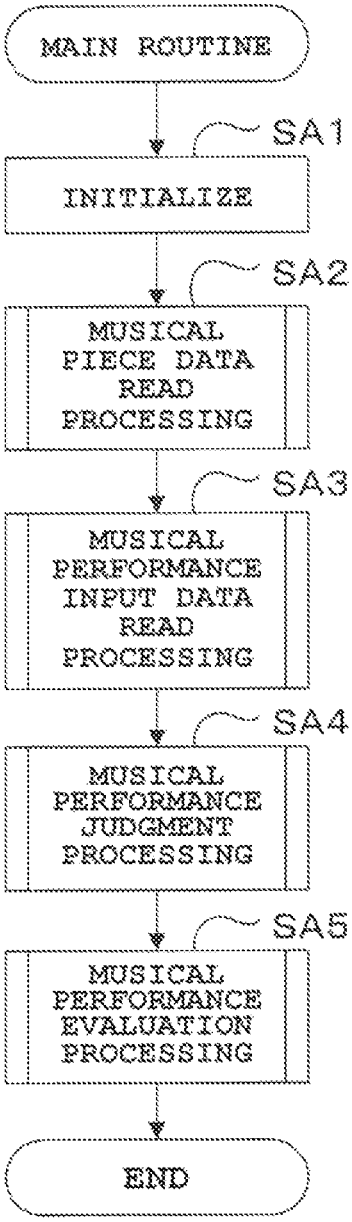
FIG. 4 is a flowchart of operations in the main routine.

FIG. 4 is a flowchart of the operation of the main routine. The main routine is performed after the musical performance data of a phrase segment inputted by musical performance by the user performing musical performance processing not shown is stored in the musical performance data input area PIE of the RAM 15, that is, after input by musical performance is performed. When the main routine is started after input by musical performance is performed, the CPU 13 proceeds to Step SA1 to initialize each section of the device.

Next, at Step SA2, the CPU 13 performs musical piece data read processing for counting the number of notes for each skill type based on note data corresponding to the phrase segment for which the musical performance input has been performed, among pieces of note data for one musical piece stored in the musical piece data area KDE of the RAM 15. This processing will be described further below.

Next, at Step SA3, the CPU 13 performs musical performance input data read processing for dividing the musical performance data of one phrase inputted by the musical performance and the note data corresponding to the phrase segment for which the musical performance input has been performed into "right-hand part", "left-hand part", and "both-hand part"; updates the correct/error table for the right hand RT based on the musical performance data and the note data of "right-hand part"; updates the correct/error table for the left hand LT based on the musical performance data and the note data of "left-hand part"; and updates the correct/error table for both hands RLT based on the musical performance data and the note data of "both-hand part". This processing will also be described further below.

Subsequently, at Step SA4, the CPU 13 performs musical performance judgment processing for counting the number of correctly played notes for each of the right-hand part, the left-hand part, and the both-hand part, and the number of correctly played notes for each skill type with reference to the correct/error table for the right hand RT, the correct/error table for the left hand LT, and the correct/error table for both hands RLT based on the note data corresponding to the phrase segment for which the musical performance input has been performed, among the note data of one musical piece stored in the musical piece data area KDE of the RAM 15. This processing will also be described further below.

Then, at Step SA5, the CPU 13 performs musical performance evaluation processing for accumulating evaluation value for the respective skill types each obtained by multiplying an accuracy rate for each skill type calculated based on the number of notes for each skill type obtained in the musical piece data read processing and the number of correctly played notes for each skill type obtained in the musical performance judgment processing by a skill value for each skill type, and thereby obtaining an overall musical performance evaluation value. This processing will also be described further below. After the musical performance evaluation processing, the main routine ends.

(2) Operation of Musical Piece Data Read Processing

Figure 5:
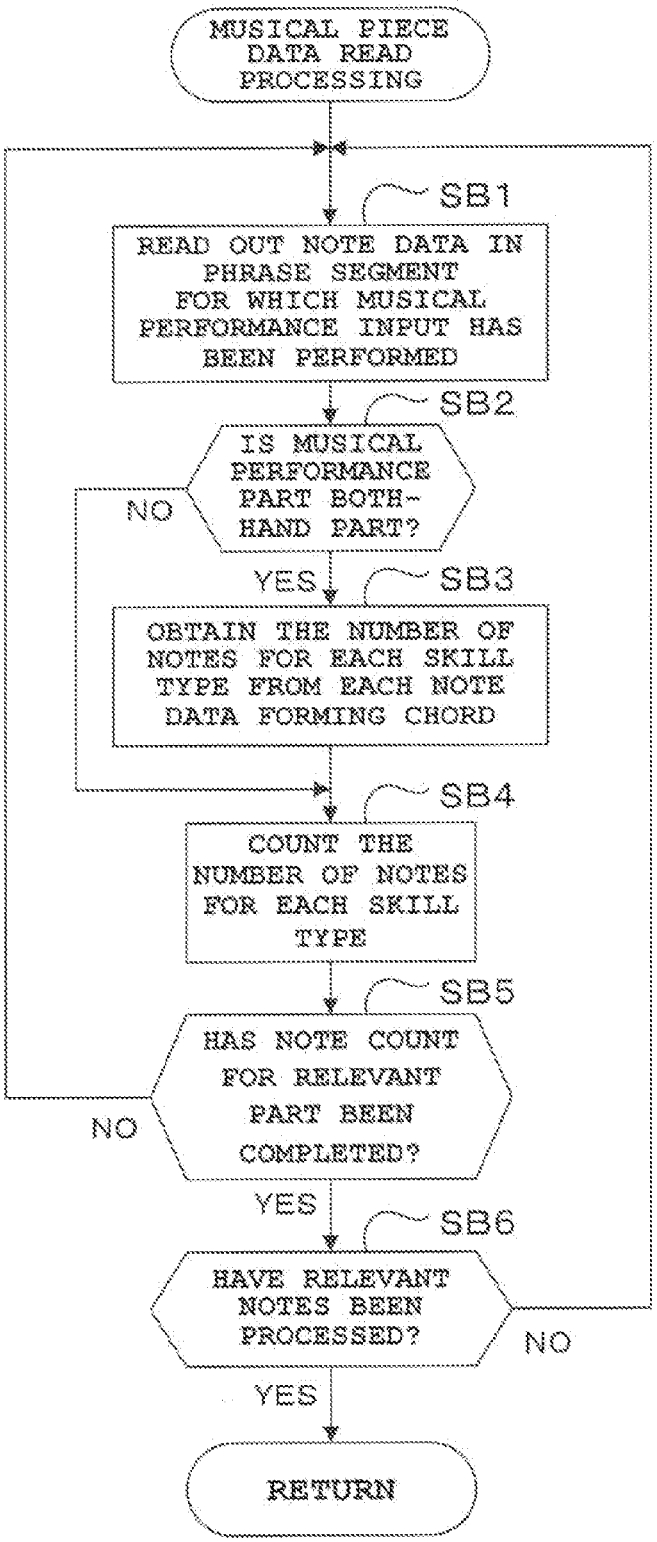
FIG. 5 is a flowchart of operations musical-piece-data read processing.

Next, the operation of the musical piece data read processing is described with reference to FIG. 5. When this processing is started via Step SA2 of the main routine described above (refer to FIG. 4), the CPU 13 proceeds to Step SB1 depicted in FIG. 5, and reads out the musical performance attribute of note data corresponding to the phrase segment for which the musical performance input has been performed among the note data of one musical piece stored in the musical piece data area KDE of the RAM 15. Subsequently, at Step SB2, the CPU 13 judges whether a musical performance part included in the musical performance attribute of the read note data is "both-hand part".

When the musical performance part is "both-hand part", since the judgment result is "YES", the CPU 13 proceeds to Step SB3 and obtains the number of notes for each skill type from each note data having the same sound emission time, that is, each note data forming a chord. The CPU 13 then proceeds to Step SB4 and counts the obtained number of notes for each skill type. Conversely, when the musical performance part is not "both-hand part", since the judgment result at Step SB2 is "NO", the CPU 13 proceeds to Step SB4, and increments a counter provided corresponding to a skill type included in the musical performance attribute of the read note data. That is, the CPU 13 counts the number of notes for each skill type.

Next, at Step SB5, the CPU 12 judges whether the counting of the number of notes for the relevant part (the right-hand part, the left-hand part, or the both-hand part) of one piece of note data has been completed. When judged that the counting of the number of notes has not been completed, since the judgment result is "NO", the CPU 13 returns to Step SB1 and counts the number of notes for each skill type for another part. When judged that the counting of the number of notes for the relevant part (the right-hand part, the left-hand part, or the both-hand part) has been completed, since the judgment result at Step SB5 is "YES", the CPU 13 proceeds to Step SB6.

Subsequently, at Step SB6, the CPU 13 judges whether the counting of the number of notes for each skill type has been completed for the entire note data included in the phrase segment for which the musical performance input has been performed. When judged that this counting of the number of notes for each skill type has not been completed, since the judgment result is "NO", the CPU 13 returns to Step SB1.

Thereafter, the CPU 13 repeats Steps SB1 to SB6 until the counting of the number of notes for each skill type is completed for the entire note data included in the phrase segment for which the musical performance input has been performed. Then, when the counting of the number of notes for each skill type is completed based on the entire note data included in the phrase segment for which the musical performance input has been performed, since the judgment result at Step SB6 is "YES", the CPU 13 ends the processing.

As such, in the musical piece data read processing, the number of notes for each skill type is counted based on the note data include in the phrase segment for which the musical performance input has been performed, among the note data of one musical piece stored in the musical piece data area KDE of the RAM 15.

(3) Operation of Musical Performance Input Data Read Processing

Figure 6:
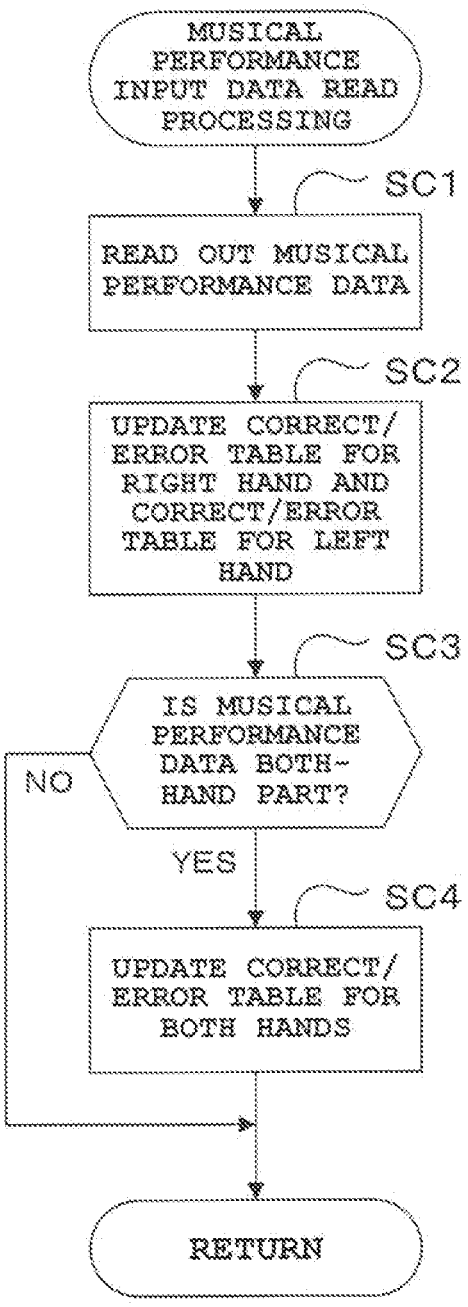
FIG. 6 is a flowchart of operations in musical performance input data read processing.

Next, the operation of the musical performance input data read processing is described with reference to FIG. 6. When this processing is started via Step SA3 of the main routine described above (refer to FIG. 4), the CPU 13 proceeds to Step SC1 depicted in FIG. 6, and reads out the musical performance data 1 to n of one phrase stored in the musical performance data input area PIE of the RAM 15 (refer to FIG. 2).

Next, at Step SC2, the CPU 13 updates the correct/error table for the right hand RT and the correct/error table for the left hand LT based on the read musical performance data 1 to n of one phrase. In the updating of the correct/error table for the right hand RT, among the read musical performance data 1 to n of one phrase, the musical performance data of the right-hand part are set as row elements on the correct/error table for the right hand RT. On the other hand, among the note data corresponding to the phrase segment for which the musical performance input has been performed, the note data of the right-hand part are set as column elements on the correct/error table for the right hand RT.

Then, among diagonal elements on the correct/error table for the right hand RT where the musical performance data of the right-hand part have been set as row elements an the note data of the right-hand part have been set as column elements, the correct/error flag of a diagonal element indicating that the note has been played in the same manner as that of the model is set at "1", and the correct/error flag of a diagonal element indicating that the note has not been played in the same manner as that of the model is set at "0".

At Step SC2, the CPU 13 also updates the correct/error table for the left hand LT in a manner similar to that for the correct/error table for the right hand RT. That is, among the read musical performance data 1 to n of one phrase, the musical performance data of the left-hand part are set as row elements on the correct/error table for the left hand LT. In addition, among the note data corresponding to the phrase segment for which the musical performance input has been performed, the note data of the left-hand part are set as column elements on the correct/error table for the left hand LT.

Then, among diagonal elements on the correct/error table for the left hand LT where the musical performance data of the left-hand part have been set as row elements and the note data of the left-hand part have been set as column elements, the correct/error flag of a diagonal element indicating that the note has been played in the same manner as that of the model is set at "1", and the correct/error flag of a diagonal element indicating that the note has not been played in the same manner as that of the model is set at "0".

Next at Step SC3, the CPU 13 judges whether the read musical performance data is both-hand part data. When judged that the read musical performance data is not both-hand part data, since the judgment result is "NO", the CPU 13 ends the processing. Conversely, when judged that the read musical performance data is both-hand part data, since the judgment result is "YES", the CPU 13 proceeds to Step SC4. At Step SC4, among the read musical performance data 1 to n of one phrase, the musical performance data of the both-hand part are set as row elements on the correct/error table for the both hands RLT. In addition, among the note data corresponding to the phrase segment for which the musical performance input has been performed, the note data of the both-hand part are set as column elements on the correct/error table for the both hands RLT.

Then, among diagonal elements on the correct/error table for the both hands RLT where the musical performance data of the both-hand part have been set as row elements and the note data of the both-hand part have been set as column elements, the correct/error flag of a diagonal element indicating that the note has been played in the same manner as that of the model is set at "1", and the correct/error flag of a diagonal element indicating that the note has not been played in the same manner as that of the model is set at "0".

As such, in the musical performance input data read processing, the musical performance data of one phrase inputted by the musical performance and the note data corresponding to the phrase segment for which the musical performance input has been performed are each divided into "right-hand part", "left-hand part", and "both-hand part", the correct/error table for the right hand RT is updated based an the musical performance data and the note data of "right-hand part", the correct/error table for the left hand LT is updated based on the musical performance data and the note data of "left-hand part", and the correct/error table for both hands RLT is updated based on the musical performance data and the note data of "both-hand part".

(4) Operation of Musical Performance Judgment Processing

Figure 7:
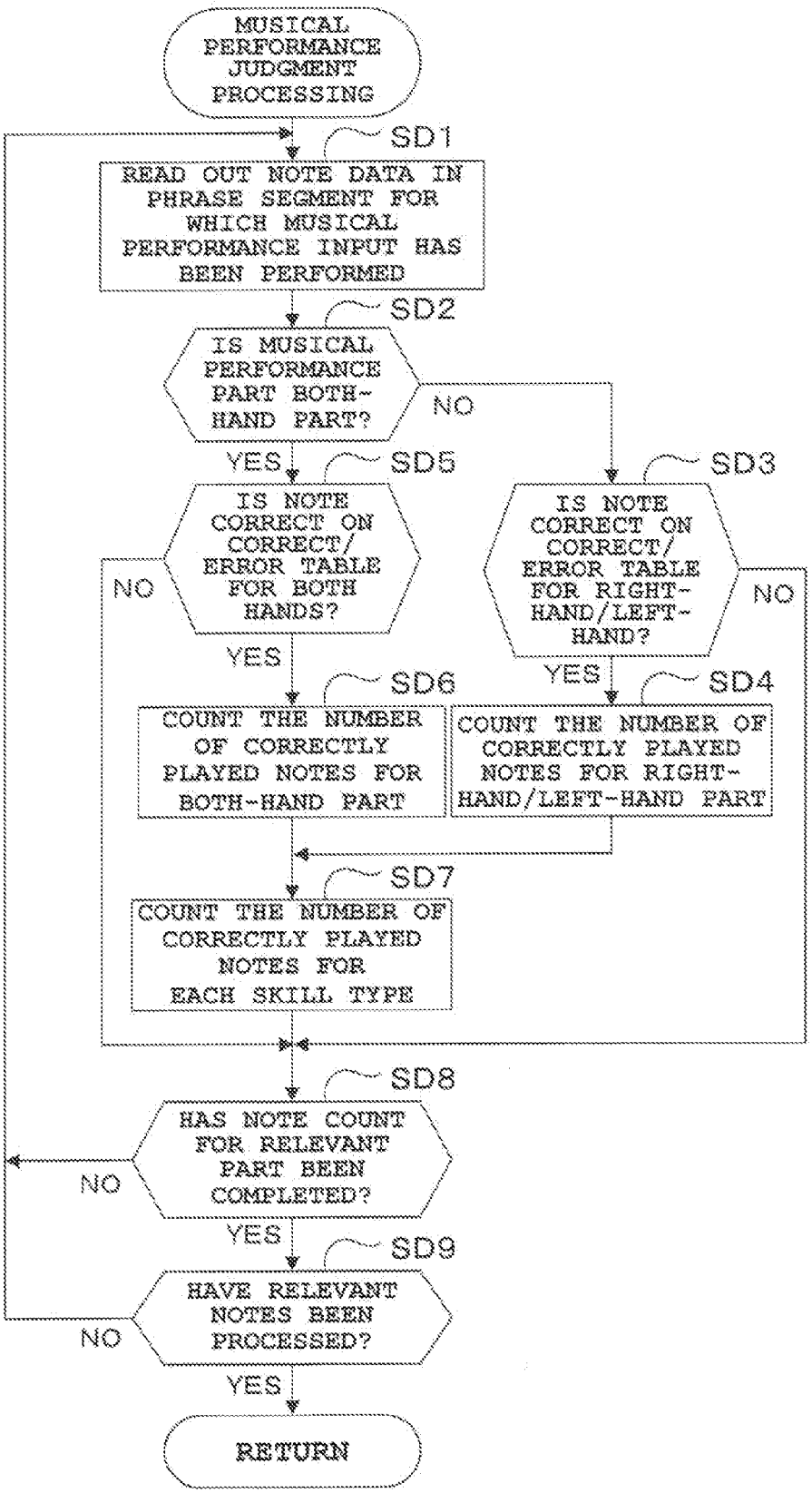
FIG. 7 is a flowchart of operations in musical performance judgment processing.

Next, the operation of the correct/error table update processing is described with reference to FIG. 7. When this processing is started via Step SA4 of the main routine described above (refer to FIG. 4), the CPU 13 proceeds to Step SD1 depicted in FIG. 7, and reads out the note data corresponding to the phrase segment for which the musical performance input has been performed, among the note data of one musical piece stored in the musical piece data area KDE of the RAM 15. Subsequently, at Step SD2, the CPU 13 judges whether a musical performance part included in the musical performance attribute of the read note data is "both-hand part".

When judged that the musical performance part is not "both-hand part", since the judgment result at Step SD2 is "NO", the CPU 13 proceeds to Step SD3. At Step SD3, the CPU 13 judges whether a correct/error flag set to a diagonal element between the read note data and its corresponding musical performance data indicates "1", or in other words, judges whether the note has been correctly played. When the musical performance part included in the musical performance attribute of the read note data is "right-hand part", this judgment is made with reference to the correct/error table for the right hand RT. When the musical performance part is "left-hand part", this judgment is made with reference to the correct/error table for the left hand LT. When the musical performance part is "both-hand part", this judgment is made with reference to the correct/error table for both hands RLT. Then, when the correct/error flag indicates "0", the CPU 13 judges that the note has been incorrectly played and, since the judgment result is "NO", proceeds to Step SD8 described below.

On the other hand, when the correct/error flag set to the diagonal element between the read note data and its corresponding musical performance data indicates "1", or in other words, when the note has been correctly played, the judgment result at Step SD3 is "YES", and therefore the CPU 13 proceeds to Step SD4 to count the number of correctly played notes for the right-hand/left-hand part. The CPU 3 then proceeds to Step SD7 to cause a counter associated with the skill types of the correctly played note data to count the number of correctly played notes.

At Step SD2, when the musical performance part included in the musical performance attribute of the read note data is "both-hand part", since the judgment result at Step SD2 is "YES", the CPU 13 proceeds to Step SD5. At Step SD5, the CPU 13 refers to the correct/error table for both hands RLT to judge whether a correct/error flag set to a diagonal element between the read note data and its corresponding musical performance data indicates "1", or in other words, the note has been correctly played. When the correct/error flag indicates "0", since the judgment result is "NO" indicating that the note has been incorrectly played, the CPU 13 proceeds to Step SD8 described below.

On the other hand, when the correct/error flag set to the diagonal element between the read note data and its corresponding musical performance data indicates that "1", that is, when the note has been correctly played, the judgment result at Step SD5 is "YES", and therefore the CPU 13 proceeds to Step SD6 to count the number of correctly played notes for the both-hand part. The CPU 13 then proceeds to step SD7 to cause a counter associated with the type of the correctly played note data to count the number of correctly played notes.

Then, at Step SD8, the CPU 13 judges whether a musical performance judgment for the relevant part (the right-hand part, the left-hand part, or the both-hand part) of one place of note data has been completed. When a musical performance judgment for the relevant part has not been completed, since the judgment result is "NO", the CPU 13 returns to Step SD1, and counts the number of correctly played notes for another part and the number of correctly played notes for each skill type. When the counting for the relevant part (the right-hand part, the left-hand part, or the both-hand part) is completed, the judgment result at Step SD8 "YES" and therefore the CPU 13 proceeds to Step SD9.

At Step SD9, the CPU 13 judges whether a musical performance judgment has been made to all pieces of the relevant note data included in the phrase segment for which the musical performance input has been performed. When judged that these musical performance judgments have not been completed, since the judgment result is "NO", the CPU 13 returns to Step SD1. Thereafter, the CPU 13 repeats Steps SD1 to SD9 until a musical performance judgment is made to all pieces of the relevant note data included in the phrase segment for which the musical performance input has been performed. Then, when a musical performance judgment is made to all pieces of the relevant note data included in the phrase segment for which the musical performance input has been performed, since the judgment result at Step SD9 is "YES", the CPU 13 ends the processing.

As such, in the musical performance judgment processing, the number of correctly played notes for each of the right-hand part, the left-hand part, and the both-hand part and the number of correctly played notes for each skill type are counted based on the note data corresponding to the phrase segment for which the musical performance input as been performed, among the note data of one musical piece stored in the musical piece data area KDE of the RAM 15.

(5) Operation of Musical Performance Evaluation Processing

Figure 8:
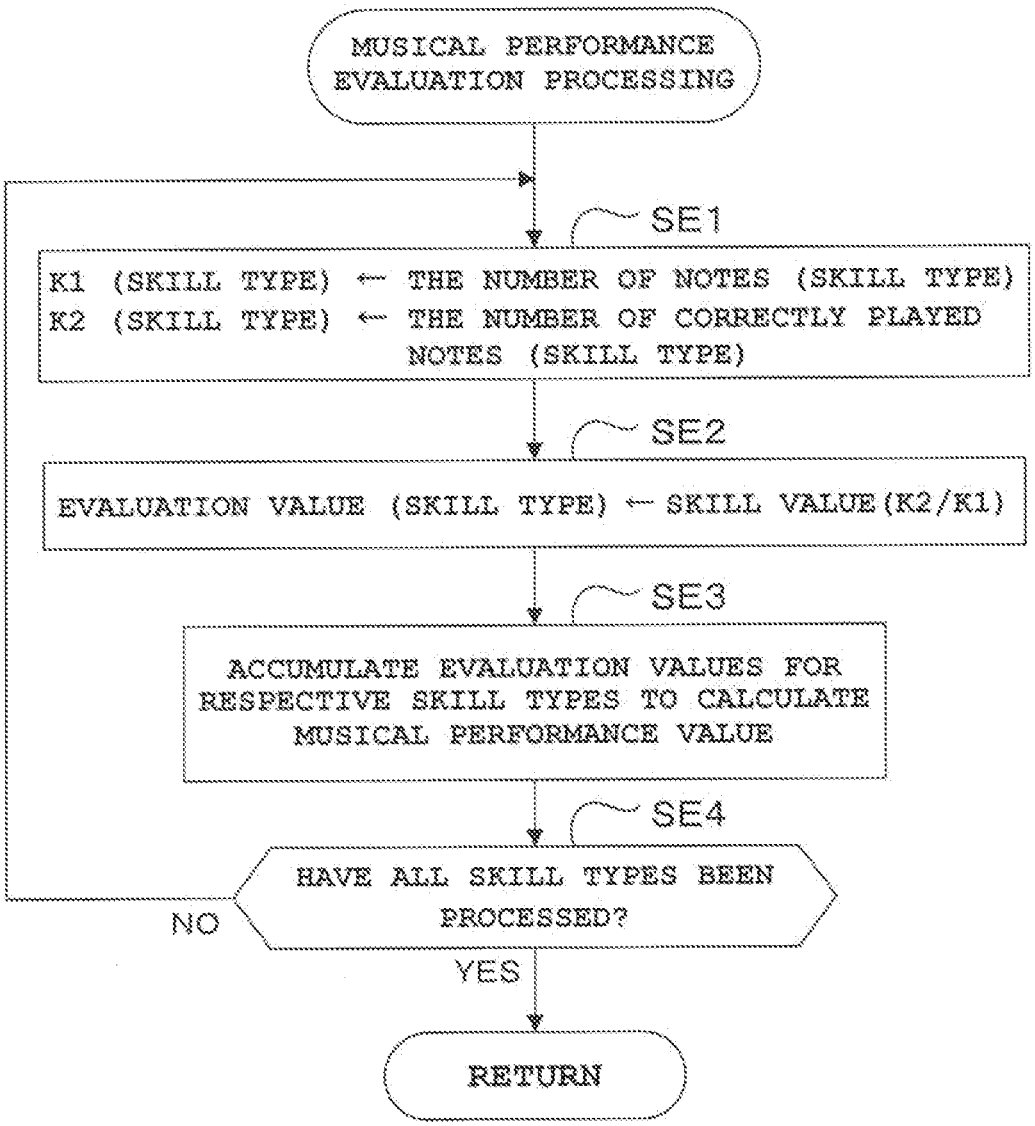
FIG. 8 is a flowchart of operations in musical performance evaluation processing.

Next, the operation of the musical performance evaluation processing is described with reference to FIG. 8. When this processing is started via Step SA5 of the main routine described above (refer to FIG. 4), the CPU 13 proceeds to Step SE1 depicted in FIG. 8 to store the number of notes for each skill type obtained in the musical piece data read processing in a register K1 (skill type) and store the number of correctly played notes for each skill type obtained in the musical performance judgment processing in a register K2 (skill type).

Subsequently, at Step SE2, the CPU 13 calculates the evaluation value (skill type) of a currently targeted skill type by multiplying the skill value of the currently targeted skill type by an accuracy rate K2/K1. Then, at Steps SE3 and SE4, the CPU 13 performs the processing of Steps SE1 and SE2 for all of the types, and accumulates the evaluation values of the respective skill types obtained thereby to calculate an overall musical performance evaluation value. Then, when the calculation of the overall musical performance evaluation value is completed, since the judgment result at Step SE4 is "YES", the CPU 13 ends the processing.

As such, in the musical performance evaluation processing, the evaluation values of the respective skill types each obtained by multiplying an accuracy rate for each skill type calculated based on the number of notes for each skill type obtained in the musical piece data read processing and the number of correctly played notes for each skill type obtained in the musical performance judgment processing by the skill value of each skill type are accumulated to obtain an overall performance evaluation value.

As described above, in the present embodiment, the number of notes for each skill type is obtained from note data included in a phrase segment for which musical performance input has been performed; the note data included in the phrase segment for which the musical performance input has been performed and musical performance data inputted by the musical performance are compared with each other to obtain the number of correctly played notes for each skill type; and the evaluation values of the respective skill types each obtained by multiplying an accuracy rate for each skill type obtained based on the number of notes for each skill type and the number of correctly played notes for each skill type by the skill value of each skill type are accumulated to obtain an overall performance evaluation value. Therefore, the degree of improvement in user's musical performance ability can be evaluated even when a musical performance practice for a part of a musical piece is performed.

Figure 9:
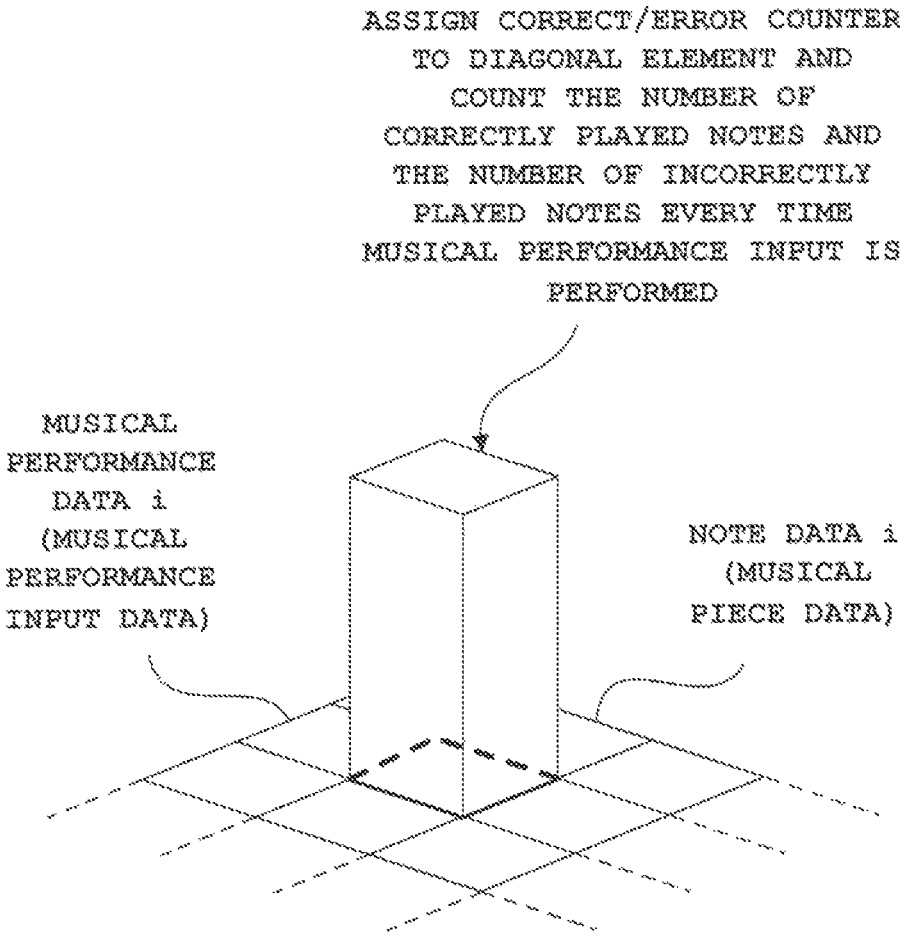
FIG. 9 is a diagram for describing a concept of a correct/error counter that is assigned to a correct/error table.

In the above-described embodiment, the number of notes and the number of correctly played notes are obtained for each skill type. However, the present invention is not limited thereto, and configuration may be adopted in which the number of notes and the number of correctly played notes for each musical performance part are obtained, and evaluation for each musical performance part is performed. Also, a configuration may be adopted in which a correct/error counter is assigned to a diagonal element on the above-described correct/error table, the number of correctly played notes or the number of incorrectly played notes is counted every time musical performance input is performed, and a portion (note) or a musical performance part that is difficult to play in musical performance is analyzed and evaluated, as depicted in FIG. 9.

While the present invention has been described with reference to the preferred embodiments, it is intended that the invention be not limited by any of the details of the description therein but includes all the embodiments which fall within the scone of the appended claims.

What is claimed is:

1. A musical performance evaluation device comprising:

a first obtaining section which obtains number of notes for each skill type from note data included in a segment of an inputted musical piece, among pieces of note data including at least a skill value and a skill type for each sound constituting the musical piece;

a second obtaining section which obtains number of correctly played notes for each skill type by comparing the note data included in the predetermined segment of the inputted musical piece among the pieces of note data and inputted musical performance data; and an evaluating section which accumulates evaluation values of respective skill types each obtained based on an accuracy rate for each skill type defined by the number of notes and the number of correctly played notes for each skill type obtained by the first obtaining section and the second obtaining section and a skill value of each skill type, and generates a musical performance evaluation value.

2. The musical performance evaluation device according to claim 1, wherein the note data and the musical performance data are each provided with a musical performance part attribute;

wherein the first obtaining section obtains the number of notes for each skill type for each musical performance part attribute;

the second obtaining section obtains the number of correctly played notes for each skill type for each musical performance part attribute; and the evaluating section generates the musical performance evaluation value for each musical performance part attribute.

3. The musical performance evaluation device according to claim 1, further comprising:

a keyboard which inputs the musical performance data in response to a press/release key operation.

4. A musical performance evaluation method executed by a musical performance evaluation device including a control unit and memory, the method comprising the steps of:

obtaining, by the control unit, number of notes for each skill type of a plurality of specified skill types with respective assigned skill values from note data read from the memory, the note data being included in a segment of an inputted musical piece, said note data including at least a skill value and a skill type for each sound constituting the musical piece;

obtaining, by the control unit, number of correctly played notes for each skill type by comparing (i) the note data included in the segment of the inputted musical piece with (ii) inputted musical performance data; and accumulating, by the control unit, evaluation values for respective skill types each obtained based on an accuracy rate for each said skill type defined by the obtained number of notes and the obtained number of correctly played notes for each said skill type and a skill value of each said skill type, and generating the accumulated evaluation values as a musical performance evaluation value.

5. The musical performance evaluation method according to claim 4, further comprising the step of:

obtaining, by the control unit, the number of notes for each said skill type for each musical performance part attribute provided to each of the note data and the musical performance data;

obtaining, by the control unit, the number of correctly played notes for each said skill type for each musical performance part attribute; and generating, by the control unit, the musical performance evaluation value for each musical performance part attribute.

6. A non-transitory computer-readable storage medium having stored thereon a program that is executable by a computer, the program being executable by the computer to perform functions comprising:

processing for obtaining number of notes for each skill type from note data included in a segment of a musical piece inputted by musical performance, among pieces of note data including at least a skill value and a skill type for each sound constituting the musical piece;

processing for obtaining number of correctly played notes for each skill type by comparing the note data included in the segment of the musical piece inputted by the musical performance among the pieces of note data and musical performance data generated by musical performance input for the segment of the musical piece; and processing for accumulating evaluation values for respective skill types each obtained based on an accuracy rate for each skill type defined by the obtained number of notes and the obtained number of correctly played notes for each skill type and a skill value of each skill type, and generating a musical performance evaluation value.

* * * * *